US010760371B2

(12) United States Patent
Krueger et al.

(10) Patent No.: US 10,760,371 B2
(45) Date of Patent: Sep. 1, 2020

(54) SYSTEM FOR LIMITING RADIAL EXPANSION OF AN EXPANDABLE SEAL

(71) Applicants: Matthew J. Krueger, Spring, TX (US); Mahmoud M. Marzouk, Rosharon, TX (US)

(72) Inventors: Matthew J. Krueger, Spring, TX (US); Mahmoud M. Marzouk, Rosharon, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 65 days.

(21) Appl. No.: 16/057,972

(22) Filed: Aug. 8, 2018

(65) Prior Publication Data

US 2020/0048982 A1 Feb. 13, 2020

(51) Int. Cl.
*E21B 33/12* (2006.01)
*E21B 33/128* (2006.01)

(52) U.S. Cl.
CPC ..... *E21B 33/1208* (2013.01); *E21B 33/128* (2013.01)

(58) Field of Classification Search
CPC ..... E21B 33/128; E21B 33/1208
See application file for complete search history.

(56) References Cited

U.S. PATENT DOCUMENTS 5,333,692 A * 8/1994 Baugh ..... E21B 33/1212 166/387
5,511,620 A * 4/1996 Baugh ..... E21B 33/1212 166/191
7,165,622 B2 * 1/2007 Hirth ..... E21B 33/12 166/387
7,748,467 B2 * 7/2010 Doane ..... E21B 33/1208 166/134
9,080,417 B2 * 7/2015 Neer ..... E21B 33/1292
9,540,899 B1 * 1/2017 Doane ..... E21B 33/12
9,657,546 B2 * 5/2017 Williams ..... E21B 33/1208
9,732,580 B2 * 8/2017 Krueger ..... E21B 33/1208
9,810,037 B2 * 11/2017 Reinhardt ..... E21B 33/129
10,180,038 B2 * 1/2019 Reinhardt ..... E21B 33/1285
10,202,818 B2 * 2/2019 Hern ..... E21B 33/1208
2004/0226724 A1 11/2004 Hirth et al.
2007/0267824 A1 11/2007 Baugh et al.
2008/0296845 A1 * 12/2008 Doane ..... E21B 33/1208 277/337

(Continued)

OTHER PUBLICATIONS

International Search Report and Written Opinion for International Application No. PCT/US2019/040756; filed Jul. 8, 2019; dated Oct. 23, 2019 (pp. 1-9).

*Primary Examiner* — Nicole Coy
(74) *Attorney, Agent, or Firm* — Cantor Colburn LLP

(57) ABSTRACT

A seal system for downhole use in a surrounding tubular includes a seal support including a frusto-conical surface, and a seal member positioned about the seal support. The seal member includes a seal support member including first side having a recess, a second, opposing side, and a seal element coupled to the second, opposing side. The seal element is engageable with the surrounding tubular. An expansion limiter is arranged between the seal support and the seal member. The expansion limiter is positioned in the recess of the seal support member to limit axial movement of the seal member relative to the frusto-conical surface.

16 Claims, 7 Drawing Sheets

(56) References Cited

U.S. PATENT DOCUMENTS

2015/0330176 A1* 11/2015 Williams ..... E21B 33/129
166/138
2017/0191342 A1 7/2017 Turley

* cited by examiner

SYSTEM FOR LIMITING RADIAL EXPANSION OF AN EXPANDABLE SEAL

BACKGROUND

In the resource exploration and recovery industry, seals are often used to limit fluid flow through and between various components of a drill string and/or a casing tubular. In some cases, the seal includes a sealing member coupled to a support. The support is shifted along a conical surface resulting in radial expansion of the sealing member. Radial expansion of the seal brings the sealing member into contact with a structure positioned adjacent to, and radially outwardly of, the conical surface.

In some instances, it is desirable to limit radial expansion of the seal. Limiting radial expansion may reduce stress that could result in cracking of the steel support and, ultimately lead to a loss of sealing capability. Various designs have been used to limit seal expansion. For example, some systems rely on rings that may extend about an outer diameter of the sealing member. In some cases, the rings may nest with gaps formed between adjacent ribs of the sealing member.

In such designs all interactions are between metallic components, e.g., the conical surface and the support, and the ring, and the casing. Metal to metal interactions may limit an over efficacy of seal integrity. That is, as a setting force is applied, the sealing member begins to conform to the inner surface of the casing or other tubular. As the sealing member conforms, the ring contacts the inner surface of the casing to prevent over expansion. However, once ring contact is established, the sealing member ceases to further conform. Therefore, the art would be appreciative of an expansion limiter for a seal that allows a sealing member to continue to conform to a sealing surface as radial expansion is being limited.

SUMMARY

Disclosed is a seal system for downhole use in a surrounding tubular, the seal system including a seal support including a frusto-conical surface, and a seal member positioned about the seal support. The seal member includes a seal support member including first side having a recess, a second, opposing side, and a seal element coupled to the second, opposing side. The seal element is engageable with the surrounding tubular. An expansion limiter is arranged between the seal support and the seal member. The expansion limiter is positioned in the recess of the seal support member to limit axial movement of the seal member relative to the frusto-conical surface.

Also disclosed is a resource exploration and recovery system including a first system, and a second system having a tubular string extending through a surrounding tubular. A seal including a seal support is connected to the tubular string. The seal support has a frusto-conical surface. A seal member is positioned about the seal support. The seal member includes a seal support member including a first side having recess, a second, opposing side, and a seal element coupled to the second, opposing side. The seal element is engageable with the surrounding tubular. An expansion limiter is arranged between the seal support and the seal member. The expansion limiter is positioned in the recess of the seal support member to limit axial movement of the seal member relative to the frusto-conical surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
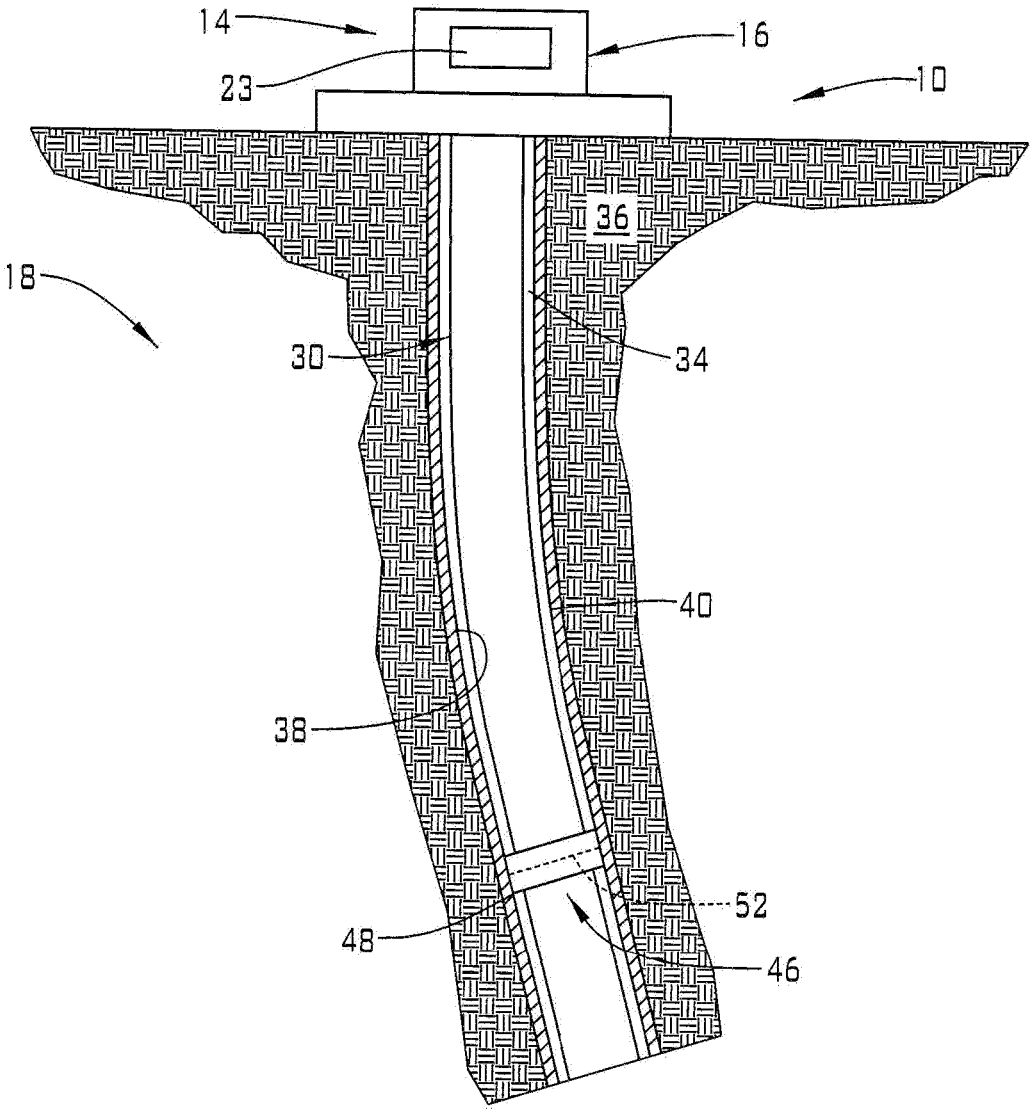
FIG. 1 depicts a resource exploration and recovery system including a system for limiting radial expansion of an expandable seal member, in accordance with an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Wellbore 34 includes an annular wall 38 which may be defined by a surface of formation 36, or, in the embodiment shown, by a casing tubular 40.

Tubular string 30 may be formed by a series of interconnected discrete tubulars, or by a single tubular that could take the form of coiled tubing. Tubular string 30 supports a seal system 46 that may be selectively set to isolate one portion of wellbore 34 from another. While only a single seal system is shown, it should be understood that multiple seal systems may be employed to create a number of fluidically isolated zones along tubular string 30.

Figure 2:
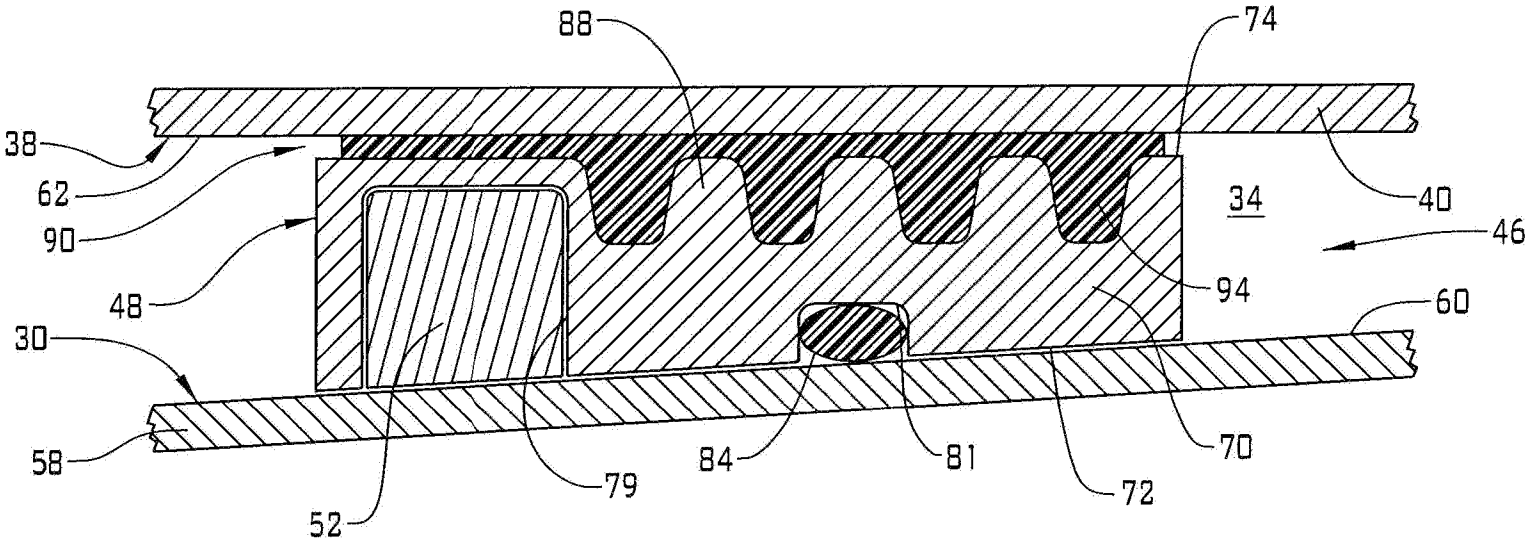
FIG. 2 depicts a cross-sectional view of an expandable seal member and an expansion limiter, in accordance with an exemplary aspect.

In an embodiment, seal system 46 includes an expandable seal member 48 and an expansion limiter 52. Expansion limiter 52 limits radial outward expansion of expandable seal member 48. Referring to FIG. 2, tubular string 30 includes a seal support 58 having a radial outer frusto-conical surface 60. Annular wall 38 defines a radial inner surface 62. Expandable seal member 48 is posited between and activated to seal against radial outer frusto-conical surface 60 and inner surface 62.

In an embodiment, expandable seal member 48 includes a seal support member 70 having a first side 72 and a second, opposing side 74. Seal support member 70 may be formed from a material that is annealed to promote elongation (expansion) with relatively low expansion forces. First side 72 includes a first recess 79 and a second recess 81. A seal 84, shown in the form of an O-ring, is arranged in second recess 81. It should be understood that seal 84 may take on various formed including molded elastomer members. Seal 84 seals against radially outer frusto-conical surface 60 of seal support 58. Seal support 58 could take the form of a mandrel. Second side 74 includes a plurality of ribs 88 that project outwardly of seal support member 70. Ribs 88 support a seal element 90 formed from an elastomer 94 that is selectively urged against radial inner surface 62 of casing tubular 40.

In an embodiment, expansion limiter 52 nests within first recess 79. As expandable seal member 48 is shifted along outer radial frusto-conical surface 60, seal support member 70 expands forcing seal element 90 into contact with radial inner surface 62. More specifically, axially shifting seal system 46 along outer radial frusto-conical surface 60 causes seal support member 70 to expand thereby allowing seal element 90 to be forced against and conform to any irregularities in radial inner surface 62 to form a robust seal. Expansion limiter 52 prevents seal support member 70 from expanding beyond selected dimensions in order to maintain compressive forces on seal element 90 below predetermined limits.

Figure 3:
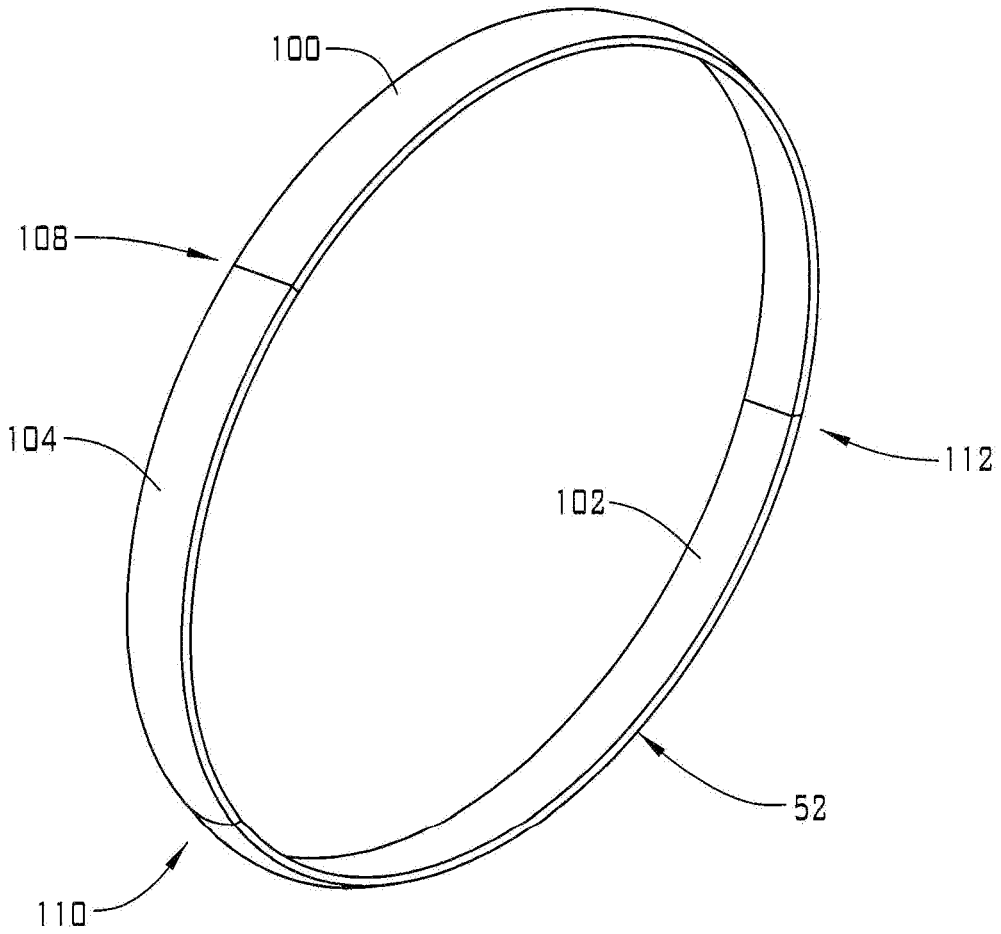
FIG. 3 depicts a perspective view of an expansion limiter, in accordance with an exemplary aspect.

In an embodiment, expansion limiter 52 may be formed from a material that possess a stiffness and hardness greater than that of seal support member 70. For example, expansion limiter may be formed from wrought low alloy steels. As shown in FIG. 3, expansion limiter 52 is formed from a number of segments including a first segment 100, a second segment 102, and a third segment 104. The number of segments may vary. Segments 100, 102, 104 are arranged in an annulus with end portions (not separately labeled) having straight end surfaces 108, 110, and 11:2. Of course, segments may include end portions having different geometries including those forming expansion joints as will be discussed herein.

Expansion limiter 52 operates to increase contact pressure between seal element 90 and radial inner surface 62 as seal support member 70 travels over outer radial frusto-conical surface 60. The increase in contact pressure acts as a stop limiting the travel of seal support member 70. The increase in contact pressure also enhances seal ability of seal system 46. At this point, it should be understood that while shown as being generally rectangular, the cross-section of the expansion limiter may vary.

Figure 4:
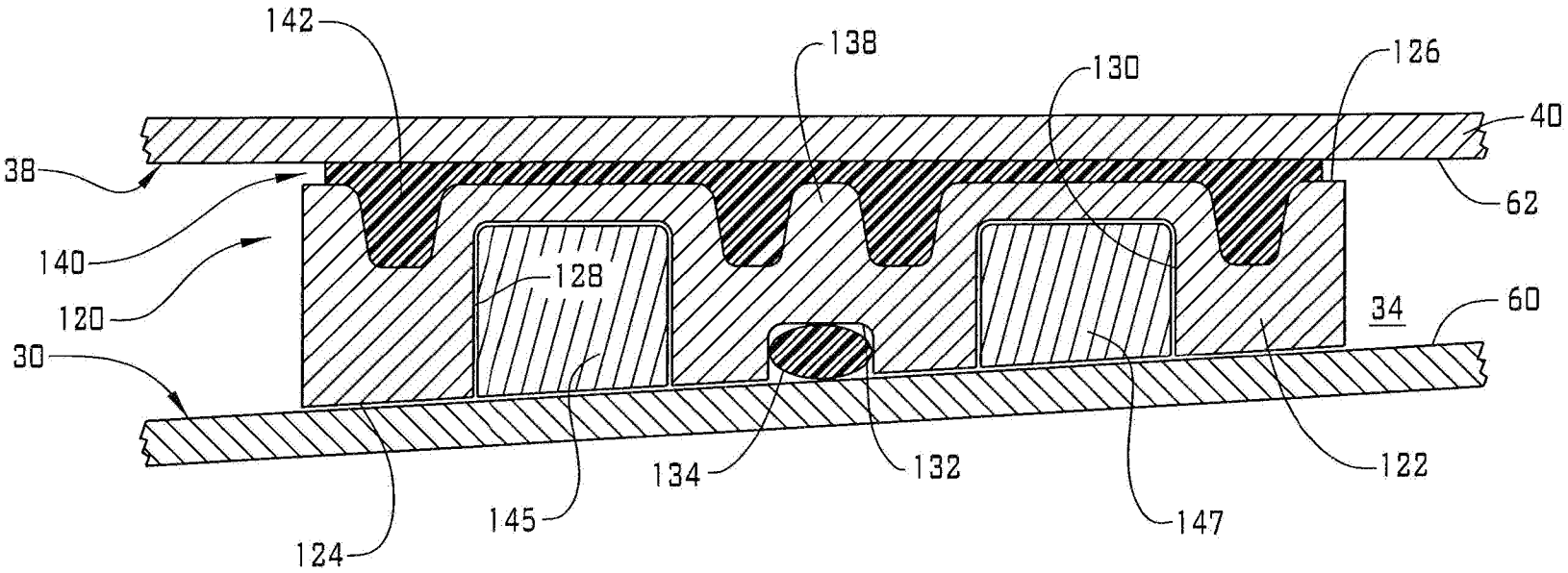
FIG. 4 depicts a cross-sectional view of an expandable seal member including two expansion limiters, in accordance with another aspect of an exemplary embodiment.

Reference will now follow to FIG. 4, wherein like reference numbers represent corresponding parts in the respective views, in describing an expandable seal member 120 in accordance with another aspect of an exemplary embodiment. Expandable seal member 120 includes a seal support member 122 having a first side 124 and an opposing second side 126. First side 124 includes a first recess 128, a second recess 130 and a third recess 132 that is receptive of an O-ring seal. 1.34.

Second side 126 includes a plurality of ribs 138 that support, a seal element 140 formed from an elastomer 142. In an embodiment, a first expansion limiter 145 is arranged in first recess 128 and a second expansion limiter 147 is arranged in second recess 130. First and second expansion limiters 145 and 147 limit travel of seal support member 122 over outer radial frusto-conical surface 60 in a manner similar to that discussed herein.

Figure 5:
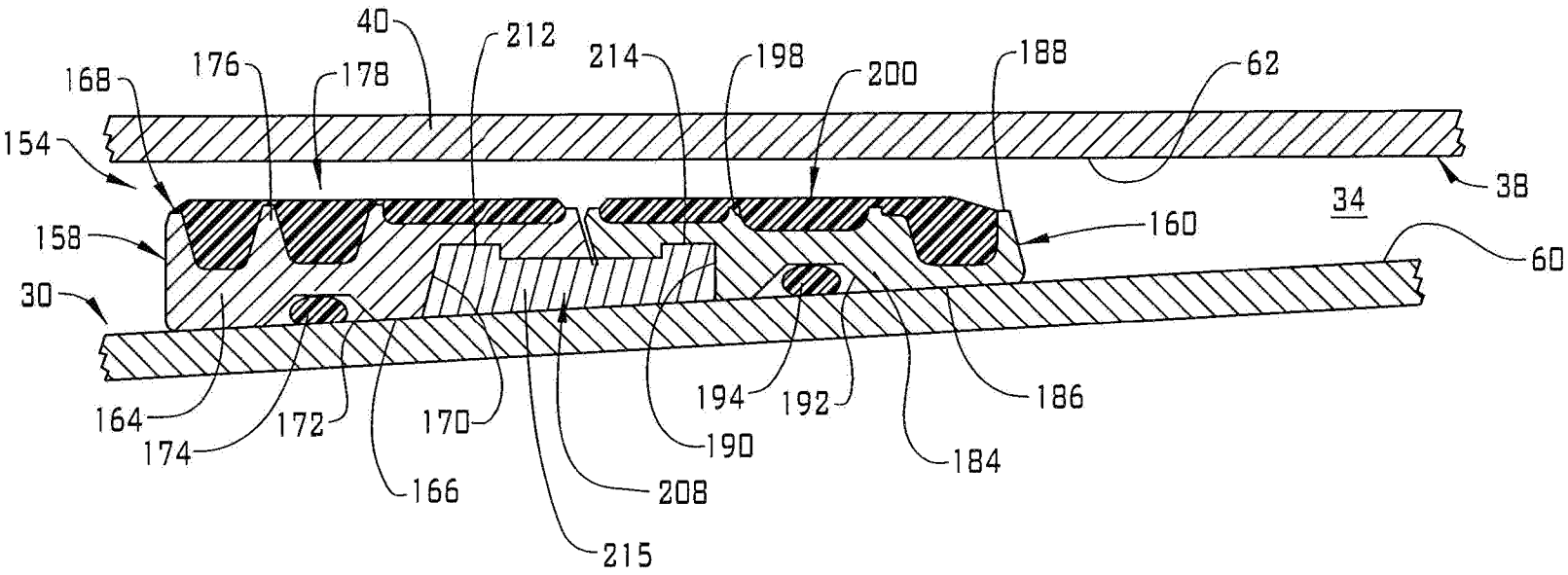
FIG. 5 depicts a cross-sectional view of two expandable seal members mechanically linked by an expansion limiter in an un-set configuration, in accordance with yet another aspect of an exemplary embodiment.
Figure 6:
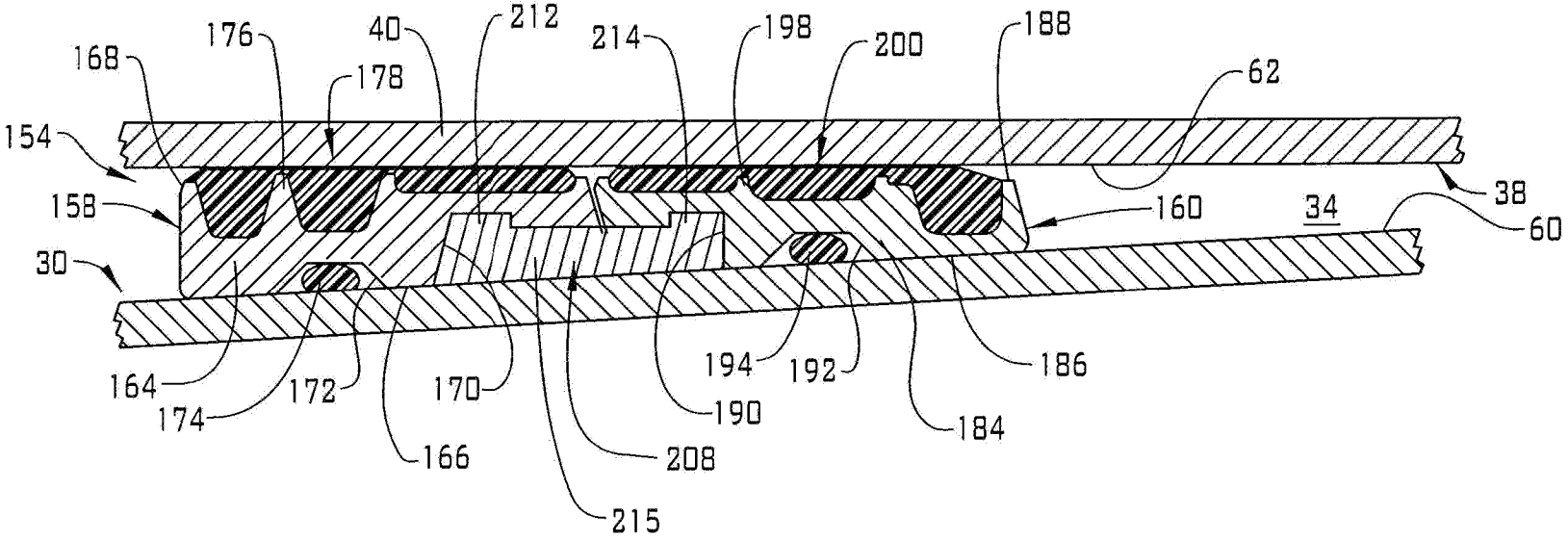
FIG. 6 depicts a cross-sectional view of two expandable seal members mechanically linked by an expansion limiter in a set configuration, in accordance with yet another aspect of an exemplary embodiment

Reference will now follow FIGS. 5 and 6, wherein like reference numbers represent corresponding parts in the respective views, in describing a seal system 154 in accordance with another aspect of an exemplary embodiment. Seal system 154 includes a first expandable seal member 158 mechanically connected to a second expandable seal member 160. First expandable seal member 158 includes a first seal support member 164 having a first side 166 and an opposing second side 168. First side 166 includes a first recess 170 and a second recess 172 that may be receptive of a seal 174, shown in the form of an O-ring. In a manner similar to that discussed herein, seal 174 may take on various forms including molded elastomer members. Second side 168 includes a plurality of ribs 176 that supports a seal element 178.

Second expandable seal member 160 includes a second seal support member 184 having a first side 186 and an opposing second side 188, First side 186 includes a first recess 190 and a second recess 192 that may be receptive of a seal 194 shown in the form of an O-ring. As discussed herein, seal 194 may take on various forms including molded elastomer members. Second side 188 includes a plurality of ribs 198 that support a seal element 200. An expansion limiter 208 mechanically connects first seal support member 164 with second seal support member 184. Expansion limiter 208 includes a first outwardly projecting tab 212 and a second outwardly projecting tab 214 joined by a central web 215. First outwardly projecting tab 212 extends into first recess 170 of first seal support member 164 and second outwardly projecting tab 214 extends into first recess 190 of second seal support member 184.

Figure 7:
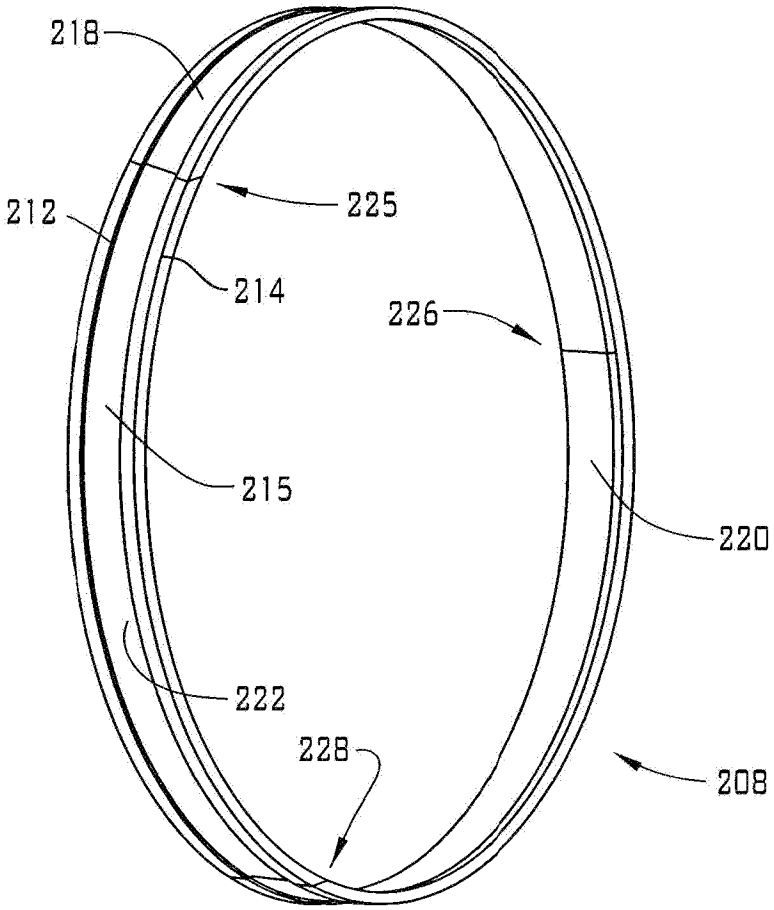
FIG. 7 depicts a perspective view of the expansion limiter of FIG. 5, in accordance with an exemplary aspect.

In FIG. 7, expansion limiter 208 is shown formed from multiple segments including a first segment 218, a second segment 220, and a third segment 222. The number of segments may vary. Segments 218, 220, and 222 are arranged in an annulus with end portions (not separately labeled) having straight end surfaces 225, 226, and 228.

Figure 8:
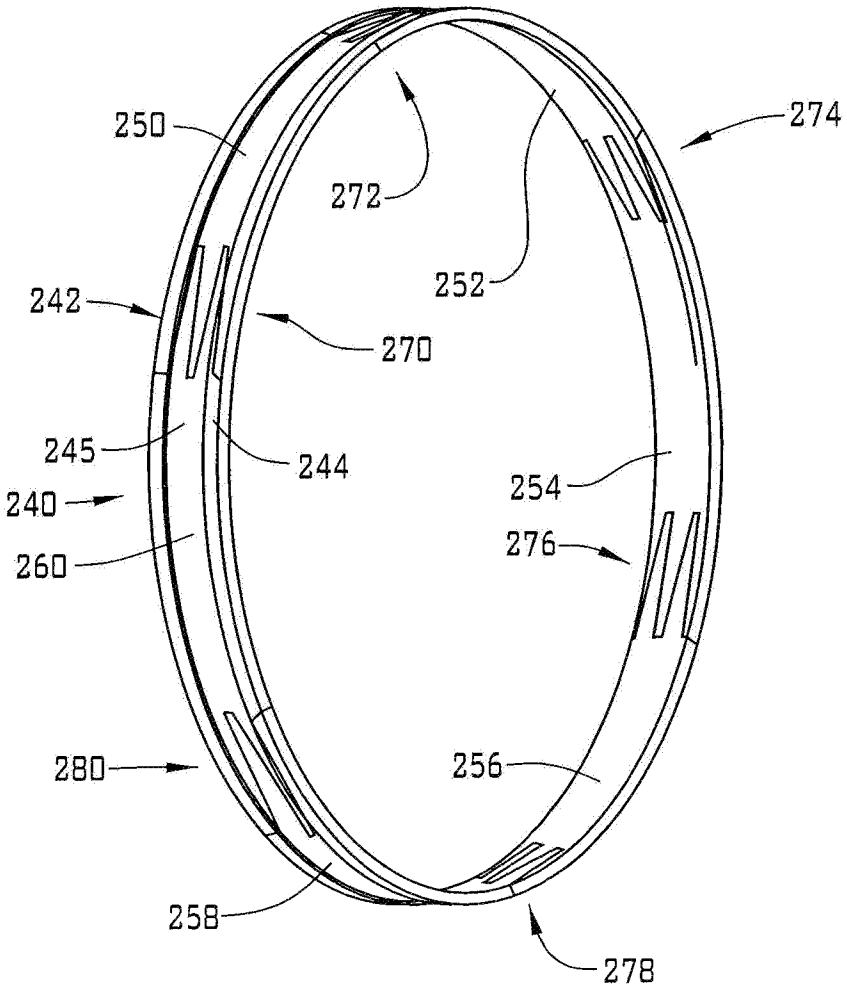
FIG. 8 depicts a perspective view of the expansion limiter of FIG. 5, in accordance with another aspect of an exemplary aspect.

FIG. 8 depicts an expansion limiter 240 including a first outwardly projecting tab 242 and a second outwardly projecting tab 244 connected through a central web 245. Expansion limiter 240 is formed from multiple segments including a first segment 250, a second segment 252, a third segment 254, a fourth segment 256, a fifth segment 258, and a sixth segment 260. The number of segments may vary. Segments 250, 252, 254, 256, 258, and 260 are arranged in an annulus with end portions (not separately labeled) defining expansion joints 270, 272, 274, 276, and 278 that accommodate radial expansion of first and second seal supports 164 and 184.

Although not shown, the expansion limiters described herein may be provided with a coating, including particles that enhance grip with outer radial frusto-conical surface 60. It should also be understood that the expansion limiters allow the seal elements to fully contact and conform to the inner surface of the casing tubular (or other tubular) thereby enhancing seal integrity.

Set forth below are some embodiments of the foregoing disclosure:

Embodiment 1

A seal system for downhole use in a surrounding tubular, the seal system comprising a seal support including a frusto-conical surface; a seal member positioned about the seal support, the seal member including a seal support member including first side having a recess, a second, opposing side, and a seal element coupled to the second, opposing side, the a seal element being engageable with the surrounding tubular; and an expansion limiter arranged between the seal support and the seal member, the expansion limiter being positioned in the recess of the seal support member to limit axial movement of the seal member relative to the frusto-conical surface.

Embodiment 2

The seal system according to any prior embodiment, wherein the second, opposing side includes a plurality of ribs supporting the seal element.

Embodiment 3

The seal system according to any prior embodiment, wherein the seal element is formed from an elastomer.

Embodiment 4

The seal system according to any prior embodiment, wherein the expansion limiter includes a plurality of segments.

Embodiment 5

The seal system according to any prior embodiment, wherein one or more of the plurality of segments include straight end surfaces.

Embodiment 6

The seal system according to any prior embodiment, wherein the plurality of segments are joined through one or more expansion joints.

Embodiment 7

The seal system according to any prior embodiment, further comprising: another seal member arranged directly adjacent the seal member, wherein the expansion limiter mechanically connects the seal member and the another seal member.

Embodiment 8

The seal system according to any prior embodiment, wherein the another seal member includes another seal support member having a first side including a recess, a second, opposing side, and a seal element coupled to the second, opposing side, the seal element being engageable with the surrounding tubular.

Embodiment 9

The seal system according to any prior embodiment, wherein the expansion limiter includes a first radially projecting tab arranged in the recess of the seal member and another radially projecting tab arranged in the recess of the another seal member.

Embodiment 10

A resource exploration and recovery system comprising a first system; and a second system including a tubular string extending through a surrounding tubular; a seal including a seal support connected to the tubular string, the seal support having a frusto-conical surface; a seal member positioned about the seal support, the seal member including a seal support member including first side having recess, a second, opposing side, and a seal element coupled to the second, opposing side, the seal element being engageable with the surrounding tubular; and an expansion limiter arranged between the seal support and the seal member, the expansion limiter being positioned in the recess of the seal support member to limit axial movement of the seal member relative to the frusto-conical surface.

Embodiment 11

The resource exploration and recovery system according to any prior embodiment, wherein the second, opposing side includes a plurality of ribs supporting the seal element.

Embodiment 12

The resource exploration and recovery system according to any prior embodiment, wherein the seal element is formed from an elastomer.

Embodiment 13

The resource exploration and recovery system according to any prior embodiment, wherein the expansion limiter includes a plurality of segments.

Embodiment 14

The resource exploration and recovery system according to any prior embodiment, wherein one or more of the plurality of segments include straight end surfaces.

Embodiment 15

The resource exploration and recovery system according to any prior embodiment, wherein the plurality of segments are joined through one or more expansion joints.

Embodiment 16

The resource exploration and recovery system according to any prior embodiment, further comprising: another seal member arranged directly adjacent the seal member, wherein the expansion limiter mechanically connects the seal member and the another seal member.

Embodiment 17

The resource exploration and recovery system according to any prior embodiment, wherein the another seal member includes another seal support member having a first side including a recess, a second, opposing side, and seal element coupled to the second, opposing side, the seal element being engageable with the surrounding tubular.

Embodiment 18

The resource exploration and recovery system according to any prior embodiment, wherein the expansion limiter includes a first radially projecting tab arranged in the recess of the seal member and another radially projecting tab arranged in the recess of the another seal member.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A seal system for downhole use in a surrounding tubular, the seal system comprising:

a seal support including a frusto-conical surface;

a seal member positioned about the seal support, the seal member including a seal support member including first side having a recess, a second, opposing side, and elastomeric seal element being engageable with the surrounding tubular; and an expansion limiter arranged between and in contact with the seal support and the seal support member, the expansion limiter being positioned in the recess of the seal support member to limit axial movement of the seal member relative to the frusto-conical surface.

2. The seal system according to claim 1, wherein the second, opposing side includes a plurality of ribs supporting the elastomeric seal element.

3. The seal system according to claim 1, wherein the expansion limiter includes a plurality of segments.

4. The seal system according to claim 3, wherein one or more of the plurality of segments include straight end surfaces.

5. The seal system according to claim 3, wherein the plurality of segments are joined through one or more expansion joints.

6. The seal system according to claim 1, further comprising: another seal member arranged directly adjacent the seal member, wherein the expansion limiter mechanically connects the seal member and the another seal member.

7. The seal system according to claim 6, wherein the another seal member includes another seal support member having a first side including a recess, a second, opposing side, and a seal element coupled to the second, opposing side, the seal element being engageable with the surrounding tubular.

8. The seal system according to claim 7, wherein the expansion limiter includes a first radially projecting tab arranged in the recess of the seal member and another radially projecting tab arranged in the recess of the another seal member.

9. A resource exploration and recovery system comprising:

a first system; and a second system including a tubular string extending through a surrounding tubular;

a seal including a seal support connected to the tubular string, the seal support having a frusto-conical surface;

a seal member positioned about the seal support, the seal member including a seal support member including first side having recess, a second, opposing side, and elastomeric seal element coupled to the second, opposing side, the elastomeric seal element being engageable with the surrounding tubular; and an expansion limiter arranged between and in contact with the seal support and the seal member, the expansion limiter being positioned in the recess of the seal support member to limit axial movement of the seal member relative to the frusto-conical surface.

10. The resource exploration and recovery system according to claim 9, wherein the second, opposing side includes a plurality of ribs supporting the elastomeric seal element.

11. The resource exploration and recovery system according to claim 9, wherein the expansion limiter includes a plurality of segments.

12. The resource exploration and recovery system according to claim 11, wherein one or more of the plurality of segments include straight end surfaces.

13. The resource exploration and recovery system according to claim 11, wherein the plurality of segments are joined through one or more expansion joints.

14. The resource exploration and recovery system according to claim 9, further comprising: another seal member arranged directly adjacent the seal member, wherein the expansion limiter mechanically connects the seal member and the another seal member.

15. The resource exploration and recovery system according to claim 14, wherein the another seal member includes another seal support member having a first side including a recess, a second, opposing side, and seal element coupled to the second, opposing side, the seal element being engageable with the surrounding tubular.

16. The resource exploration and recovery system according to claim 15, wherein the expansion limiter includes a first radially projecting tab arranged in the recess of the seal member and another radially projecting tab arranged in the recess of the another seal member.

* * * * *